US006031334A

United States Patent [19]

Meyer

[11] Patent Number: 6,031,334

[45] Date of Patent: Feb. 29, 2000

[54] METHOD AND APPARATUS FOR SELECTIVELY DISTRIBUTING POWER IN A THRUSTER SYSTEM

[75] Inventor: Steven D. Meyer, Snohomish, Wash.

[73] Assignee: Primex Technologies, Inc., Redmond, Wash.

[21] Appl. No.: 09/143,294

[22] Filed: Aug. 28, 1998

Related U.S. Application Data

[60] Provisional application No. 60/089,562, Jun. 17, 1998.

[51] Int. Cl.[7] ..... H05H 1/00

[52] U.S. Cl. ..... 315/111.01; 315/111.81; 313/359.1; 60/202

[58] Field of Search ..... 315/111.81, 111.21, 315/111.91, 106, 111.01, 344; 313/359.1; 60/202

[56] References Cited

U.S. PATENT DOCUMENTS

| | | | |
|---|---|---|---|
| 3,708,716 | 1/1973 | Berwin | 315/30 |
| 4,247,801 | 1/1981 | Dallos et al. | 315/107 |
| 4,317,983 | 3/1982 | Scheffels et al. | 219/121 EA |
| 4,594,630 | 6/1986 | Rabinowitz et al. | 361/13 |
| 4,638,149 | 1/1987 | Wesset et al. | 313/359.1 |
| 4,687,970 | 8/1987 | Musslyn et al. | 315/106 |
| 4,733,530 | 3/1988 | Beattie et al. | 60/202 |
| 4,766,724 | 8/1988 | Gruber | 60/203.1 |
| 4,800,716 | 1/1989 | Smith et al. | 60/203.1 |
| 4,825,646 | 5/1989 | Challoner et al. | 60/202 |
| 4,838,021 | 6/1989 | Beattie | 60/202 |
| 4,887,005 | 12/1989 | Rough et al. | 315/111.21 |
| 4,894,567 | 1/1990 | Lenk | 307/542 |
| 4,918,285 | 4/1990 | Thommes | 219/130.1 |
| 4,977,352 | 12/1990 | Williamson | 315/111.81 |
| 4,995,231 | 2/1991 | Smith et al. | 60/203.1 |
| 5,075,594 | 12/1991 | Schumacher et al. | 315/111.21 |
| 5,132,597 | 7/1992 | Goebel et al. | 315/344 |
| 5,357,747 | 10/1994 | Myers et al. | 60/203.1 |
| 5,369,953 | 12/1994 | Brophy | 315/111.01 |
| 5,475,354 | 12/1995 | Valentian et al. | 335/296 |
| 5,581,155 | 12/1996 | Morozov et al. | 315/111.21 |
| 5,605,039 | 2/1997 | Meyer et al. | 60/204 |
| 5,646,476 | 7/1997 | Aston | 315/111.81 |
| 5,713,075 | 1/1998 | Threadgill et al. | 455/427 |
| 5,722,042 | 2/1998 | Kimura et al. | 455/13.1 |
| 5,740,164 | 4/1998 | Liron | 370/316 |

OTHER PUBLICATIONS

*Multiple Thruster Propulsion Systems Integration Study*, by Rusakov, A.V.; Kochergin, A.V.; Semenkin, A.V,; Tverdokhlebov, S.O. and Garkusha, V.I.; Central Research Institute of Machien Building (TsNIIMASH), Korolev, Moscow Region, Russia, pp. 826–831.

U.S. Patent Application Serial No. 09/058,314 filed Apr. 9, 1998, by Cassady et al. entitled, "Three Axis Thruster".

U.S. Patent Application Serial No. 08/984,895 filed Dec. 4, 1997 by S. Meyer, entitled, "Cathode Current Sharing Apparatus and Method Therefor".

*Primary Examiner*—Hoanganh Le
*Assistant Examiner*—Wilson Lee
*Attorney, Agent, or Firm*—Wiggin & Dana; Gregory S. Rosenblatt

[57] ABSTRACT

A single power control circuit selectively distributes power from a power supply to cathode heater, cathode keeper and thruster magnets of a thruster. The power control circuit utilizes a plurality of switching devices to direct power to one or more of the heater, keeper, and magnet components.

21 Claims, 3 Drawing Sheets

METHOD AND APPARATUS FOR SELECTIVELY DISTRIBUTING POWER IN A THRUSTER SYSTEM

This is a continuation application of provisional application U.S. Ser. No. 60/089,562 filed Jun. 17, 1998 which is incorporated by reference in its entirety herein.

BACKGROUND OF THE INVENTION

1. Field of the Invention

This invention relates to a method and apparatus for selectively providing electrical current to cathode heater, cathode keeper, and one or more magnets of a thruster system. More particularly, this invention relates to a single power control circuit with output switching capabilities to effectively monitor and control cathode heater, cathode keeper and thruster magnet power levels in ionic thrusters.

2. Description of the Art

A conventional spacecraft thruster, such as a Hall current thruster, utilizes various operating components. These components include a cathode heater, a cathode emitter, a cathode keeper and one or more thruster magnets. Each of these operating components requires power and therefore, has an associated power controller to regulate the amount of power received from the spacecraft power supply. This design is inefficient since the control circuitry requires area and adds additional weight to the system. Therefore it is desirable in satellite and spacecraft applications to minimize the amount of equipment necessary to operate a thruster. Thus, an invention that combines multiple functions using a single apparatus that does not increase the mass of the thruster is advantageous. Various systems for discharge generation and control are summarized below. None of these address the problem of providing a single power converter and distribution circuit for efficient distribution of power to thruster elements.

U.S. Pat. No. 5,075,594 issued Dec. 24, 1991 to Schumacher et al., discloses a hollow cathode capable of self-heating by back ion bombardment to a thermionic emission temperature. Electrons are axially or radially extractable from a plasma by an anode of opposite polarity. A voltage is applied to a keeper electrode disposed between the cathode and the anode to sustain the plasma discharge of the gas between the cathode and keeper electrode. A control electrode is disposed between the keeper electrode and the anode. Application of a negative control electrode voltage, or returning the control electrode to cathode potential, causes the plasma discharge to retract back to the area of the keeper electrode, thereby opening a switch. This patent does not disclose a single distribution and control circuit to control multiple system functions.

U.S. Pat. No. 5,132,597, issued Jul. 21, 1992 to Goebel et al., discloses a hollow cathode plasma switch with a magnetic field. A diverging magnetic field is established between a cathode and a control electrode of a hollow cathode plasma switch to expand the plasma at a passageway through the control electrode, thus significantly increasing the current handling of capability of the switch. This dispersion of the plasma across the control electrode produces a uniform current density such that the total interruptible current can be increased by increasing the grid and anode area. This patent fails to disclose a thruster system that has a single controller for providing power to thruster components.

U.S. Pat. No. 5,357,747, issued Oct. 25, 1994 to Myers et al., discloses a pulsed mode cathode with an internal heater and a low work function material. The cathode is preheated to an operating temperature and then the thruster is fired by discharging a capacitor bank. This patent is hereby incorporated by reference in its entirety herein.

U.S. Pat. No. 5,581,155, issued Dec. 3, 1996 to Morozov et al., discloses a plasma accelerator with closed electron drift. This plasma accelerator has a main annular channel for ionization and acceleration, at least one hollow cathode associated with ionizable gas feed means and an annular anode. This plasma accelerator reduces divergence of the ion beam and increases the density of the ion beam and lifetime of the accelerator. This patent does not disclose an apparatus to distribute converted power.

U.S. Pat. No. 5,605,039, issued Feb. 25, 1997 to Meyer et al., discloses a parallel arcjet starter system for ignition and sustaining an electric arc in an arcjet thruster. This patent is hereby incorporated by reference in its entirety herein.

U.S. Pat. No. 5,646,476, issued Jul. 8, 1997 to Aston, discloses a channel ion source. A gas, ionizable to produce a plasma, is introduced into a channel within an ion source and into a hollow cathode imbedded within the ion source. A heater and keeper electrode power supply is used to establish a hollow cathode and keeper electrode plasma. A discharge power supply is used to cause electrons to flow from the hollow cathode in a predominantly one hundred and eighty degree direction to bombard the channel gas distribution and create a channel discharge plasma. This power supply is not selectively distributed to desired elements.

As can be seen from illustrative background discussed above, there is a need in the thruster industry for an improved method and apparatus for controlling cathode heater, cathode keeper and thruster magnet components of a thruster. The present invention provides a solution to that need in the form of a power control circuit with output switching that is capable of selectively controlling the heater, keeper and magnet functions thereby more efficiently providing and controlling the application of power to the thruster components.

SUMMARY OF THE INVENTION

The instant invention is directed to a system that satisfies the problem of unnecessary weight and additional components by providing a method and apparatus that selectively distributes power to elements of a thruster using switches and distribution paths.

In accordance with one embodiment of the invention there is disclosed a control apparatus that includes a cathode assembly that contains heater, emitter and keeper elements. A power supply supplies power that is distributed to the cathode heater and cathode keeper elements through a power converter and distribution circuit. The power converter and distribution circuit selectively provides power to the keeper, the heater thereby minimizing the overall complexity of the thruster system while more efficiently providing the desired control function. This selective provision of power is accomplished by one or more switching devices.

A second embodiment utilizes one or more magnetic devices to control the output from the cathode assembly. The magnetic device(s) can also receive power from the power distribution circuit.

A third embodiment of the instant invention is an apparatus for selectively controlling operation of a thruster component. The apparatus includes a thruster assembly for producing a discharge. The apparatus also includes a cathode assembly with emitter, keeper and heater elements. One or more magnetic devices are operatively associated with the thruster assembly for providing a magnetic field to control direction or acceleration of the discharge produced by the assembly. A power supply provides electrical power to a power distribution circuit that converts the received power and selectively distributes the power to specific elements.

A fourth embodiment of the present invention is a method for controlling the operation of plasma discharge components of a thruster. This method comprises the steps of generating an ion beam and a magnetic field by selectively distributing converted power received from a power source. The power from the source is distributed to the ion beam generating location and/or the magnetic field generating device by the process of selectively switching the power to the beam generator and the magnetic field generator in a controlled preprogrammed sequence or based on received commands.

DETAILED DESCRIPTION OF THE INVENTION

The invention provides a more efficient method and apparatus for distributing power to thruster components. This power distribution, from a power source, to the thruster components is accomplished by replacing multiple conventional power converters with a single power converter and distribution circuit that controls the cathode heater, cathode keeper and thruster magnet functions.

Figure 1:
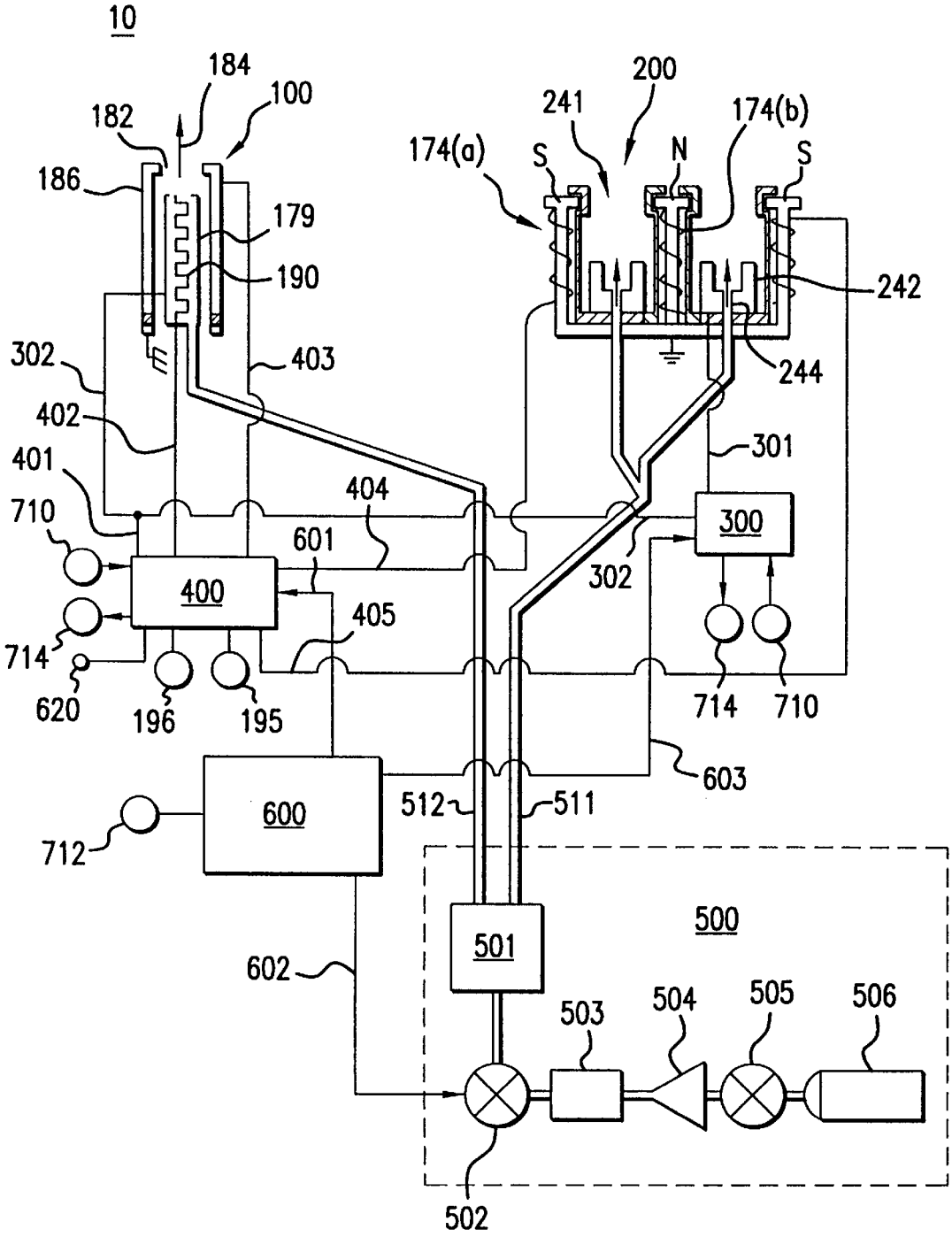
FIG. 1 shows a schematic view of a thruster system in accordance with the instant invention.

FIG. 1 shows a Hall current thruster system 10. System 10 comprises a cathode assembly 100, a Hall current thruster 200, a discharge power supply 300, a power converter and distribution circuit 400, a propellant system 500, a thruster control circuit 600, and a power source 710. FIG. 1 also shows a plurality of electrical interconnects between the system components.

Cathode assembly 100 consists of a cathode emitter 179, a cathode heater 190, and a keeper 186. The cathode assembly 100 has an orifice 182 for discharging an electron beam 184.

The cathode emitter 179 is suitably a hollow tube of material optimized for thermionic emission of electrons. A gas, such as xenon, is passed through the tube to aid in the removal of electrons from the hollow tube. The cathode emitter 179 emits an electron beam 184 through an orifice 182 in the keeper 186.

The heater 190 is used to raise the temperature of the cathode emitter 179 to stimulate electron emission. The heater 190 is suitably wrapped around the emitter 179 to effectively heat the emitter 179. Maintaining the cathode emitter 179 at its thermionic emission temperature (i.e., the temperature at which a cathode emitter 179 will emit electrons) prolongs the operational life of a cathode emitter because forcing a cathode emitter to emit electrons when it is not heated causes it to experience increased erosion as well as making starting it difficult. The cathode emitter 179 is usually heated initially by the heater 190 and during steady state operation the emitter is heated by the cathode discharge current.

The keeper 186 provides a selective barrier to protect the cathode emitter 179 and heater 190 from damage from ions from the thruster 200. The keeper 186 is provided with an electrical potential that is positive with respect to the cathode emitter 179. The keeper 186 draws electrons out of the cathode emitter to initiate a cathode discharge.

The thruster 200 has an ionization chamber 241, anode 242 and magnetic poles 174(*a*) and 174(*b*) for creating a hall current force. The hall current force is used to retard electron flow from cathode emitter 179 to anode 242. Electrons trapped by the hall current due to the magnetic field cause the formation of an electric field that accelerates an ionized propellant provided to the ionization chamber 241 through a distribution system 244 in the anode 242.

The cathode assembly 100 and the thruster 200 receive a quantity of propellant, such as xenon, or any other gas that is ionizable within the desired parameters, from propellant system 500. The propellant system 500 includes a flow splitter 501, valves 502, 505, a propellant source 506 and a flow control circuit 503. Flow splitter 501 receives propellant from low pressure valve 502 and provides propellant to the cathode assembly 100 via conduit 512, and propellant to thruster 200 through conduit 511. Flow control circuit 503 may be a simple gas restrictor or a device that can actively regulate the flow such as a thermal throttle. This device may also be located on the thruster side of the low pressure valve 502. The propellant system 500 also will typically contain a pressure regulator 504 that reduces the gas pressure to a low pressure such as 30 PSI. High pressure valve 505 isolates the high pressure propellant storage source 506. This high pressure valve 505 may be a one time use valve such as a pyro valve (high-pressure squib valve) or could be a latch valve or holding type valve.

A discharge power supply circuit 300 provides power to the anode 242 to operate the thruster 200 through interconnection means, such as a wire, 301. Discharge power supply 300 is suitably connected to the cathode assembly 100 through interconnection means, such as a wire, 302. The discharge power supply circuit 300 converts power received from the spacecraft at input 710 to a source of power for the anode 242. The discharge power supply return 302 connection could be through additional elements, such as current sensor (not shown). The discharge power supply circuit 300 also receives input 603 from thruster control circuit 600. The positive terminal of discharge power supply 300 is coupled to the anode 242 to provide the necessary power to the anode 242.

The cathode assembly 100 receives electric current from the power converter and distribution circuit 400 through a plurality of interconnectors, such as wires 401, 402, and 403. The power converter and distribution circuit 400 receives power from power supply 710 and returns power via return 714. This circuit 400 also receives control signals via path 601 from thruster control circuit 600.

The power converter and distribution circuit 400 provides power for preheating the cathode heater 190, via conduit 402. The power converter and distribution circuit 400 also produces a cathode ignition voltage for starting a discharge in the cathode and a sustaining current for maintaining the cathode discharge. The power converter and distribution circuit 400 further provides electrical current to operate the thruster electromagnets 174(*a*) and (*b*) via interconnection means 404 and 405.

In some applications the magnets 174(*a*) and (*b*) are operated from the discharge current. In these applications, the power converter and distribution circuit 400 does not provide power to the magnets 174(*a*) and (*b*). Rather the discharge power provides the required power to the magnets 174(*a*) and (*b*). Alternatively, the magnets 174(*a*) and (*b*) are suitably permanent magnets. In these situations power converter and distribution circuit 400 is not required to provide magnet power.

Auxiliary control power supplies 195 and 196 are provided to supply additional power to power converter and distribution circuit 400. These supplies 195, 196 could be coupled to the spacecraft ground 714 or an associated control ground (not shown). Zener diodes (not shown) can be used in conjunction with the auxiliary power supplies to prevent over voltage failure modes.

Thruster control circuit 600 is a control circuit for providing input to other subsystems of thruster system 10. Thruster control circuit 600 is for example a programmable micro processor that is programmed to transmit preprogrammed control signals to the other subsystems.

Alternatively, thruster control circuit 600 is suitably configured to receive input via port 712 from another processor such as one located on the spacecraft or one located at a remote location.

The thruster control circuit 600 provides signals via interconnection 601 to the power converter and distribution circuit 400. These signals can be used by the power converter and distribution circuit 400 to control the power distributed to the cathode assembly 100 and magnets 174(*a*) and (*b*). Thruster control circuit 600 is also suited to provide control signals to the propellant subsystem 500 via interconnection 602. This signal can control the amount of propellant provided to the thruster 200 and/or the cathode assembly 100 from the propellant subsystem 500. Thruster control circuit 600 is also suited to provide control signals to the discharge power supply circuit 300 via interconnection 603. These signals control how much power the discharge power supply circuit 300 provides to the anode 242.

Power supply 710 is connected to the power converter and distribution circuit 400. The supply 710 is typically a positive supply with a magnitude of approximately 70 volts. Satellites commonly use power bus voltages from 22 volts to 150 volts. The return 714 is a voltage return for power supply 710. Power supply 710 and power return 714 are also suited to be connected to the discharge power supply circuit 300.

Figure 2:
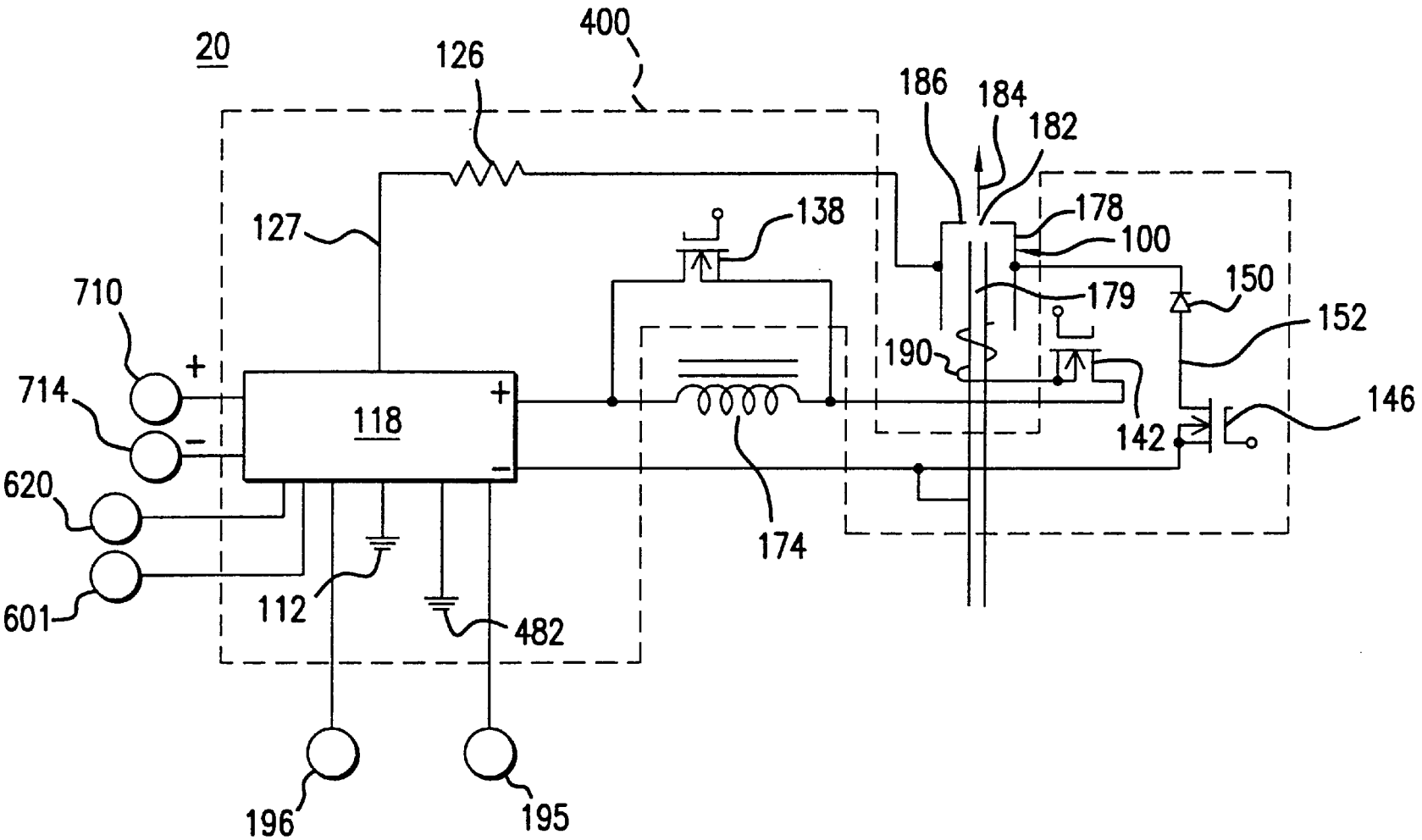
FIG. 2 shows a diagram of a first embodiment of control circuitry for use in the thruster system of this invention.

FIG. 2 shows a more detailed diagram of power converter and distribution circuit 400, cathode assembly 100 and magnet 174 (magnet 174 denotes the magnets 174(*a*) and (*b*) shown in FIG. 1).

The power converter and distribution circuit 400 includes a power control circuit 118, associated switches, and ignition voltage output 127. Power control circuit 118 is capable of generating ignition voltage and outputting this voltage via wire 127. The magnitude of this voltage is typically between 200 and 700 volts and preferably 400–650 volts.

Power is received from source 710 by power control circuit 118, which converts the received power to a controlled current suitable for selective distribution to the thruster magnet 174 (if necessary), cathode heater 190 and the cathode keeper 186. The output of power control circuit 118 is 119 with a current return path 120. The power control circuit 118 is normally configured to provide a current output. The magnitude of the current is a function of the thruster magnet design. Typically, the current will range from approximately 1 ampere to 20 amperes, and preferably, 1 ampere to 10 amperes. The highest current is usually required when providing current to heat the cathode heater 190.

Power control circuit 118 can have programmed logic to drive switches 138, 142, 146 and 150 or can receive commands via lines 601 and 620, which can be outputs from command apparatus such as one or more micro-processors. The power control circuit 118 distributes the converted power received from input 710 via output 119 and ignition voltage 127. Power control circuit 118 suitably receives input from auxiliary power supplies 195 and 196. Power control circuit 118 is also connected to control ground 714 and is sufficiently robust to withstand common mode noise. The controlled output current produced by the power control circuit 118 is distributed to the required locations by switches 138, 142, 146, and 150.

Switches 138, 142 and 146 are suitably MOSFETS but any device capable of turning "ON" and "OFF" the flow of electrical current could be used. Switch 150 is typically a diode, but other devices capable of directing current flow could also be used. The switches 138, 142, 146 and 150 are operated in a way to direct current through a desired path such that current from power control circuit 118 is supplied to either the cathode heater 190, cathode keeper 186 or the thruster magnet 174, or any combination thereof.

Switch 150 is typically a diode and provides a current path to direct current from power control circuit 118 to the keeper 186. When switch 150 is conducting electrical current, the keeper 186 receives electrical current. Switch 150 is suitably capable of being reversed biased to enable an increased voltage thereby causing ignition. This state of operation can be implemented if the switch 150 is in a non-conducting state and electrical current is not reaching the keeper 186.

Alternatively, in an embodiment in which the thruster uses permanent magnets, or the magnets are designed in series with the discharge current, the magnet 174 does not need electrical current and switch 138 would not be utilized.

Series impedance 126 may be added to limit the ignition current generated in the power control circuit 118 and output through wire 127. Alternate methods of limiting the current from the ignition voltage could also be used. The ignition current could be present at all times or turned on only when needed for cathode ignition.

The operation of the power converter and distribution circuit 400 is best illustrated by an example of starting. It should be realized that there are many possible variations in the illustrated sequence that will be evident to those skilled in the art.

The operation of the distribution circuit is controlled by sequencing logic. This sequencing logic may be implemented with digital logic, a microprocessor, or could be directed by a spacecraft processor, ground control personnel or ground station computers. Power control circuit 118 can be preprogrammed with the sequencing logic or can receive signals from a remote location.

The first step in starting the discharge generator apparatus 20, is to preheat the cathode emitter 179 by applying electric current to the cathode heater 190. This is done by having switch 146 open (i.e., not conducting electrical current) and switch 142 closed (i.e., conducting current). Switch 138 may be open or closed. The power control circuit 118 is turned on by a logic command and produces the required current for preheating the cathode emitter 179.

The required electrical current is dependent on the cathode heater design but is often between 1 and 30 amperes and typically between 1 and 10 amperes. This current is maintained for sufficient time to allow the cathode emitter 179 to reach an adequate temperature for starting the emission of electrons. This temperature is dependent on the design of the cathode assembly 100 and material used to fabricate the cathode emitter. The starting temperature is normally in excess of 750 degrees Celsius and typically between 800 degrees Celsius to 1700 degrees Celsius. The preheating time can be determined by timing or by using the heater voltage drop as a measure of temperature. The current may be also applied to the thruster magnet 174 during this time to preheat the thruster (not shown). This is done by having switch 138 open to allow current to flow from the power control circuit 118 through the magnet 174. The current may bypass the thruster magnet 174 during this time by closing switch 138.

The second step is to supply propellant to the cathode assembly 100. The propellant flow to the thruster may be applied at this time or may be delayed if the valves allow such flexibility.

The third step is to apply ignition voltage via output 127, if the design allows it to be turned off. This voltage has a magnitude of typically 300 to 600 volts that helps to ionize the propellant to initiate initial breakdown. This voltage can be generated from the power control circuit 118. One method of generation is by one or more auxiliary windings on a transformer (not shown) of the power control circuit 118. The ignition voltage may be energized at all times or only activated when needed.

Series resistors 126, or other means known to those skilled in the art can be used to limit the current present on output 127. The current can be limited to approximately 6 mA.

The next step is to adjust the power control circuit 118 to provide the initial current required for sustained discharge into the keeper 186 by opening switch 142 thereby allowing the current to be diverted into the keeper 186. A typical current for this mode is 0.5 to 8 amperes. During this time, switch 138 is closed in order to prepare for starting the thruster.

When the cathode emitter 179 is operating, the required current can be sustained with switch 142 open. If the cathode emitter 179 failed to ignite, additional preheating may be necessary.

The next step is to apply discharge voltage to the thruster. Upon detecting the presence of anode current, the magnet current can be applied by turning "OFF" (i.e., opening) switch 138.

The thruster magnet 174 generates a magnetic field to trap electrons so that an acceleration electronic field can be generated thereby providing a propelling or adjusting thrust for the spacecraft.

When the cathode heater 190 has exceed a predetermined temperature, switch 142 turns "OFF" and if switch 146 is "OFF" electrical current will flow to the keeper 186 through node 152 and diode 150. This current will initiate a steady state keeper discharge mode of operation of the cathode emitter 179 In this mode, the current path from the power control circuit 118 is through magnet coil 174 or bypass switch 138, through diode switch 150 and between the keeper 186 and cathode emitter 179 and back to the return 120. The current is actually carried in the region 178 between the keeper 186 and the cathode emitter 179 mainly by electrons emitted from the cathode emitter surface. The electrons move in a direction opposite to the current flow direction since they have a negative charge.

After the thruster has been started, electrons will be flowing from the cathode emitter 179 to the thruster beam (not shown) or to the thruster (the thruster is shown in FIG. 1). Once sufficient electron current flow is established to the thruster beam and to the thruster, it is no longer necessary to maintain keeper power. To reduce keeper power but still allow magnet current to flow, switch 146 is turned "ON". When switch 146 is "ON" current will flow from the power converter 118 through node 152 and switch 146 and return to the negative return 120 of power converter 118. Switch 146 will be turned "ON" when the cathode emitter 179 is operating in a steady state mode and does not require keeper current to maintain a discharge.

Figure 3:
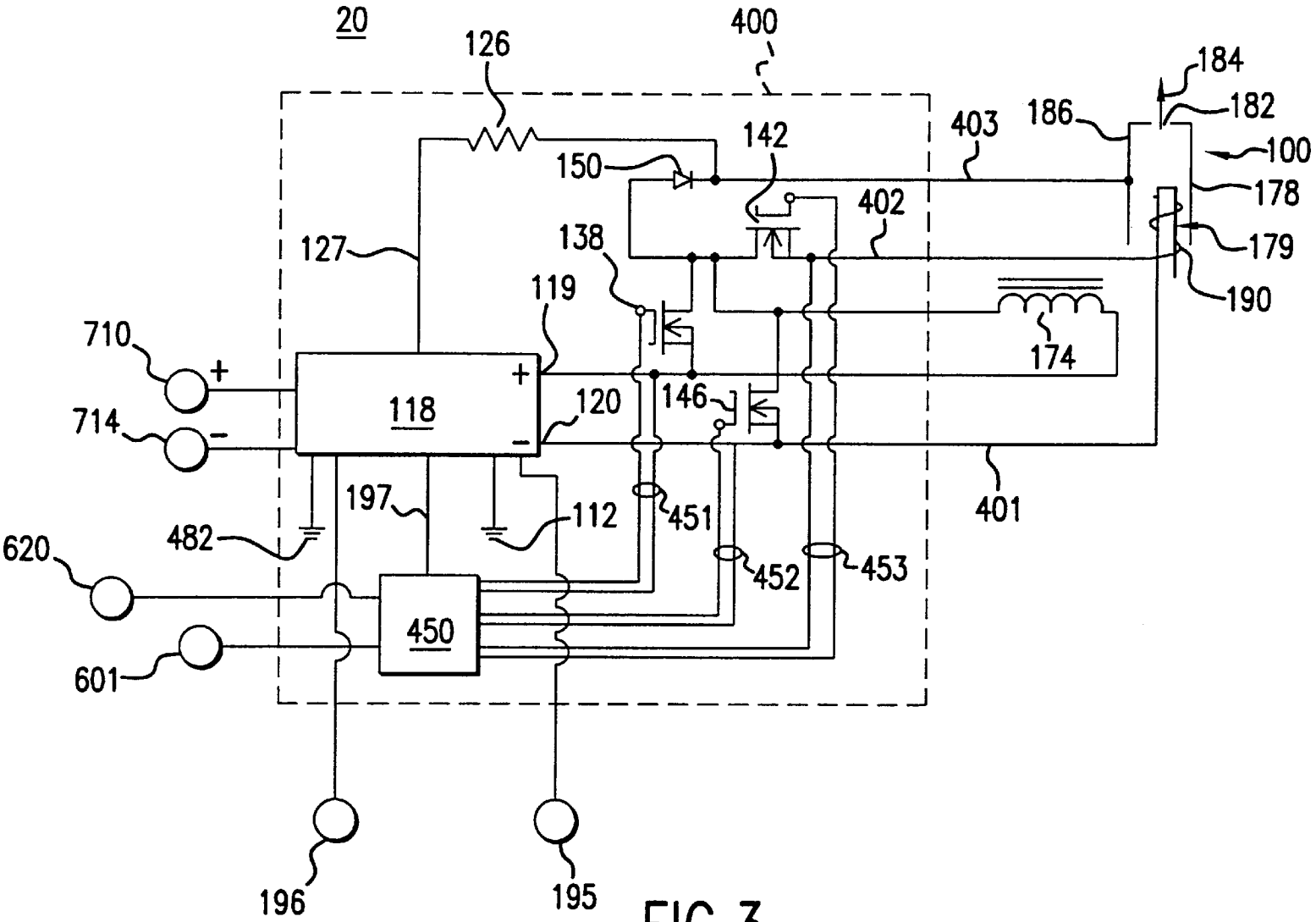
FIG. 3 shows a diagram of a second embodiment of control circuitry for use in the thruster system of this invention.

FIG. 3 shows the discharge generator 20 including the power converter and distribution circuit 400, magnet 174 (174 represents magnets 174(*a*) and (*b*) as described in FIG. 1), and cathode assembly 100. The power converter and distribution circuit 400 includes power control circuit 118 and sequencing logic unit 450 connected to the power control circuit 118 via interconnect 197, which could be any suitable means of providing electrical communication between sequencing logic unit 450 and control circuit 118.

Sequencing logic unit 450 is suitably any processor or computer that is capable of generating logic signals. Typically sequencing logic unit 450 will be a microprocessor that is on board the spacecraft but the sequencing logic unit 450 can also receive logic signals from a ground station computer, ground control personnel or another processor on board the spacecraft. Logic sequencing unit 450 is connected to switches 138,146 and 142 and provides control signals to the switches via wires 451, 452 and 453. (Wires 451, 452 and 453 consist of two wires as shown in FIG. 3.) Sequencing logic unit 450 sequences the start-up of the cathode emitter 179 and commands the power converter 118 to produce the proper output current appropriate for the mode of operation. Sequencing logic unit 450 could be implemented with a computer or micro-controller or with dedicated analog and digital circuitry.

Sequencing logic unit 450 suitably receives inputs 601 and 620, which may be connected to another processor, for example 601 is an input from thruster control circuit (shown as element 600 in FIG. 1) and 620 is suitably an input received from another spacecraft computer or a computer located remotely from the spacecraft. Alternatively sequencing logic unit 450 could be preprogrammed.

In some applications the power for power control circuit 118 may be provided directly from the input power 710. Auxiliary power sources 195 and 196 provide additional power for operation of power control circuit 118. In some implementations, auxiliary power sources 195 and 196 are identical. These auxiliary power sources are typically between approximately ±10 volts to ±15 volts with a lower voltage typically approximately 2–9 volts used for digital logic. One specific example is auxiliary control power 195 has a magnitude of +/−10 volts with a tolerance of +/−1 volt. Control power 195 is suitably grounded to the control ground, which is the same as the ground for the spacecraft or to ground 112, depending on design choice. One specific example of auxiliary control power 196 is a power source with a magnitude of +/−13.5 volts and a tolerance of +/−1 volt. Auxiliary control power supply 196 is suitably grounded to the spacecraft input power ground 714 after common mode EMI filtering, or alternatively, to ground 482, depending on design choice.

The switches 138, 142, 146 and 150 are controlled by the sequencing logic that is part of sequencing logic unit 450. FIG. 3 shows switches 138, 142 and 146 as N-channel power MOSFETs and switch 150 as a diode. These switch elements could also be bipolar transistors, P-channel MOSFETS, thyristors, such as silicon controlled rectifiers (SCR), or relays. The actual logic to drive the switches depends on the particular system specifications.

The control logic of sequencing logic unit 450 is suitably digital logic or a micro-controller that has low voltage output, for example between 2 and 10 volts. The control logic would need to be converted to an isolated drive voltage capable of driving the controlled switches. In the case of using MOSFETS, the switch gate drive voltage will need to be converted to a switch "ON" voltage of approximately between 3 and 15 volts preferably 8–12 volts and a switch "OFF" voltage of approximately zero volts or slightly negative. The sequencing logic unit 450 sets the output current from the power control circuit 118 to match the required current for the operating mode. For example, if the heater current requires 5 amperes, the power control circuit 118 commands 5 amperes. If the magnet current requires 2 amperes then 2 amperes are commanded. The method requires coordination of the cathode heater and thruster magnet design, so that the single current from converter 118 can achieve all the required functions.

The magnet current of the thruster can be tailored by changing the number of turns. It is also possible to change magnet current by operating switch 138 in a duty cycle controlled mode or in a linear mode to make magnet current less than the output current of power converter 118. In some applications, the addition of a resistor in series with switch 138 or in parallel with magnet 174, can also improve the thruster and cathode current compatibility.

The output voltage and current from the power control circuit 118 will be a function of the mode of operation of the thruster and cathode emitter. The output current will be commanded by the control signals produced by sequencing logic unit 450 and the voltage will be determined by the configuration of switches 138, 146, 142, 150 as well as the cathode and magnet voltage drops. The output 119 and output return 120 are essentially isolated from the input connection 197 and the control ground 482. The control ground 482 is typically at spacecraft chassis potential but this is not required. The output return 120 will be at the cathode emitter 179 potential, which is typically between −10 and −40 volts relative to the spacecraft chassis.

The discharge generator 20 can operate in a plurality of modes including preheating mode, super heat mode, normal heating mode, keeper mode, magnet current with keeper power mode and steady state operation supply mode. Each mode will be described using FIG. 3.

A first mode of operation is to preheat the cathode emitter 179 by transmitting an electrical current from the positive terminal 119 of the power control circuit 118 to the cathode heater 190 through switch 142, which is "ON". Electrical current may flow through the electromagnet 174 if switch 138 is "OFF." The electrical current through the electromagnet 174 can be used to preheat the thruster to improve starts when the thruster has been cold soaked due to exposure to space temperatures. Alternatively, if switch 138 is "ON" current will flow through switch 138 and bypass electromagnet 174. In the preheating mode, switch 146 is "OFF." In instances where there is no current flow through electromagnet 174, the current will flow from the positive terminal 119 of the power source 118 through switch 138 to switch 142 to the heater 190. The current will then return from the heater 190 to the negative terminal 120 of power source 118. In this example, the heater return is connected in common with the cathode emitter 179.

The magnitude of this current is typically between 3 and 9 amps but is dependent on the cathode assembly design. The magnitude of the voltage is a function of cathode heater design as well as heater temperature. A typical design supplies between 7 and 12 volts after the cathode emitter 179 has been heated. This condition of operation will continue for a time sufficient to increase the cathode emitter temperature such that a propellant, such as xenon, will allow electrons to be emitted from the cathode emitter 179. The time necessary for preheating is typically 3–5 minutes.

A super heat mode is achieved by increasing the current to the heater 190 from power control circuit 118 by approximately 30%. The added current increases the cathode emitter temperature and facilitates starting. Switch 142 is "ON", switch 146 is "OFF" and switch 138 is "ON", if needed. This super heat mode is used to provide extra heat in situations in which the cathode emitter 179 has become difficult to start. The cathode emitter 179 may also be conditioned by applying heat to burn off any impurities on the cathode assembly 100 prior to ignition. This requirement is a function of the cathode emitter material and may only be required the first time the cathode is operated following exposure to air. The current necessary in this mode has a magnitude of between approximately 4 and 12 amps and a voltage magnitude of between approximately 8 and 15 volts.

Normal heating mode is achieved by reducing the current from power control circuit 118 to heater 190 to between approximately 1.5 and 5.0 amps and preferably about 3.5 amps. The voltage is between 2.5 and 7.0 volts and preferably about 3.9 volts. This mode is used to provide an operating temperature sufficient to prevent the cathode emitter from cooling to a temperature below the operating temperature. The actual current required depends on the cathode assembly design.

Cathode ignition is aided by a high voltage input 127, which is typically between approximately 200 and 700 volts and preferably between approximately 350–600 volts. The high voltage source is fed through a current limiting device such as a resistor or a string of series resistors, which are illustrated as resistor 126 in FIG. 3. The high voltage creates a strong electric field that initiates the emission of electrons from the hot cathode emitter surface 179.

Keeper mode operates with switch 142, and switch 146 in an "OFF" state. Switch 138 may be either "ON" of "OFF" depending on whether thruster magnet current is desired. The preferred mode is to have switch 138 "ON" to improve the thruster starting ability. During the keeper mode of operation the cathode assembly 100 is emitting electrons to the keeper 186, the power control circuit current is typically controlled to the minimum current that the cathode emitter 179 can reliably operate. This current typically has a magnitude between about 1 and 5 amperes. This current is directed by control sequencing logic unit signals from sequencing logic unit 450 transmitted through current command 197.

The voltage capable of being supplied by converter 118 is between approximately 15–40 volts thereby ensuring that the cathode assembly 100 is able to start emitting electrons. Once started, the cathode discharge voltage between the cathode emitter 179 and cathode keeper 186 is typically between 5 and 25 volts, and more typically 10–20 volts. This voltage is dependant on the current supplied and also the specifications of the cathode assembly design. The keeper mode maintains a path for electrons to flow from the cathode assembly 100 to the keeper 186. In this manner, the cathode emitter 179 is ready to supply electrons to the thruster and to neutralize the ion beam (not shown) when anode power is supplied.

The thruster is started by applying anode voltage from discharge power supply 300. The anode voltage may be applied gradually to minimize the power transients reflected to the spacecraft power bus. The preferred mode of starting is dependent on the specifications of the hall current thruster design. In the illustrated case, the voltage on the thruster is brought up to between about 150 volts and 250 volts with a current limit of about 30 percent of the full power current. In the case of a 3 kilowatt thruster that operates at 300 volts normally, this would be a current limit of 3 amperes. When thruster anode current flow is detected, switch 138 is opened to allow magnet current to flow. The sequencing logic unit 450 then adjusts the magnet current to the desired current for start-up of the thruster. This current may be a function of the anode current. The anode voltage and current limit is then increased to the final values. After the discharge to the anode 242 is stable, the keeper current can be removed. This is accomplished by turning "ON" switch 146 to shunt the magnet current from the keeper 186.

A magnet current with keeper power mode operates with switches 138, 142 and 146 in the "OFF" state. The voltage supplied by power converter 118 is the sum of the keeper to cathode emitter voltage and the magnet voltage drop. The current command to power converter 118 from sequencing logic unit 450 is set to maintain the optimal thruster magnetic field during the initial operation.

Steady state operation is a mode of operation in which the thruster no longer requires the keeper 186 to be operational. In this steady state operational mode switch 146 is "ON," the voltage on the anode has increased to a steady state magnitude, which is typically between 200 and 400 volts and preferably about 300 volts. The magnitude of the current is dependent on the thruster power level and is typically between about 1.5 and 15 amps. Steady state operation, without keeper current, is desired since it does not require as much energy from the power supply 710 to keep the thruster operational. Also, power converter 118 is not required to control and monitor as much steady state power.

It should be noted that while this invention has been described in an example using a thruster, virtually any industrial processes using cathodes could also be used. Ion engines would also be another application for the present system. Specifically, the power control and distribution system can be used in satellite communication systems such as two way satellite systems and low earth orbit satellite systems as disclosed in U.S. Pat. No. 5,713,075 to Threadgill et al., issued Jan. 27, 1998; U.S. Pat. No. 5,722,042 to Kimura et al. issued Feb. 24, 1998; and U.S. Pat. No. 5,740,164 to Liron, issued Apr. 14, 1998.

It is another embodiment of the present invention that the electromagnet 174 of this system could be biased using a discharge current by placing the electromagnets 174 in series with the anode discharge current or cathode current. In this embodiment switch 138 is not needed. The design of the system must be thermally adequate for continuous operation at the magnet power output levels but operation of the heater 190 and keeper 186 is only required for a short period of time.

While the current is set by an analog input referenced to ground, it may also be a digital value or be proportional to the anode current.

It is apparent that there has been provided in accordance with this invention a method for providing a method and apparatus for controlling heater, keeper and magnet functions of a thruster. While this invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A control system comprising:

a thruster assembly for producing a discharge;

a cathode assembly for producing an electron beam, the cathode assembly having emitter, heater and keeper elements;

at least one magnetic device operatively associated with the thruster assembly for generating a magnetic field to control the discharge;

a power supply for supplying power to the system; and a power distribution circuit coupled to the cathode assembly, the at least one magnetic device, and the power supply, for selectively providing power to the keeper, the heater and the at least one magnetic device.

2. The control system as claimed in claim 1 wherein the power distribution circuit further comprises:

a power control circuit for receiving power from the power supply; and at least one switching device for providing current paths from the power control circuit to the heater or the keeper or the at least one magnetic device or combination thereof.

3. The control system as claimed in claim 2 wherein the power distribution circuit further comprises:

a sequencing logic unit coupled to the power control circuit and the at least one switching device for providing control signals to the power control circuit and the at least one switching device.

4. The control system as claimed in claim 2 further comprising:

an anode coupled to the cathode assembly for providing a voltage having a polarity opposite a polarity of the emitter; and an anode power supply coupled to the power distribution circuit for supplying power to the anode.

5. The control system as claimed in claim 2 wherein a first one of the at least one switching device provides an electrical current path from the power control circuit to the at least one magnetic device when the first switching device is in a non-conducting state.

6. The control system as claimed in claim 5 wherein a second one of the at least one switching device provides a current path from the power control circuit to the heater when the path from the power control circuit to the heater when the second switching device is in a conducting state.

7. The control system as claimed in claim 6 wherein a third one of the at least one switching device provides a current path from a positive terminal of the power control circuit to a negative terminal of the power control circuit when the third switching device is in a conducting state thereby preventing power from reaching the keeper.

8. A control apparatus comprising:

a power supply for providing a source of power;

a power distribution circuit coupled to the power supply; and a cathode assembly coupled to the power distribution circuit for discharging an electron beam, the cathode assembly enclosing heater, emitter and keeper elements;

wherein the power distribution circuit receives power from the power supply and selectively distributes the received power to one or both of the heater and the keeper elements.

9. The control apparatus as claimed in claim 8 further comprising:

at least one magnetic device operably associated with the cathode assembly for generating a magnetic field to control an ion beam discharged from a thruster assembly.

10. The control apparatus of claim 9 wherein the at least one magnetic device is coupled to the power distribution circuit; and the power distribution circuit selectively providing power received from the power supply to the at least one magnetic device.

11. The control apparatus as claimed in claim 9 wherein the at least one magnetic device receives power from a discharge path.

12. The control apparatus as claimed in claim 8 wherein the power distribution circuit further comprises:

a power control circuit for supplying a controlled amount of power to the cathode assembly; and at least one switching device coupled to the power control circuit for selectively providing current paths from the power control circuit to the cathode assembly in response to control signals transmitted from the power control circuit.

13. The control apparatus as claimed in claim 12 wherein a first one of the at least one switching device provides an electrical current path from the power control circuit to the heater when the first switching device is in a conducting state; and a second one of the at least one switching device provides an electrical current path from a positive terminal of the power control circuit to a negative terminal of the power control circuit when the second switching device is in a conducting state thereby preventing power from reaching the keeper.

14. The control apparatus as claimed in claim 12 wherein the power distribution circuit further comprises:

a sequencing logic unit coupled to the power control circuit and the at least one switching device, for providing command signals to the power control circuit and control signals to the at least one switching device.

15. The control apparatus as claimed in claim 12 wherein the power control circuit generates an ignition voltage and transmits the ignition voltage to the keeper.

16. The control apparatus as claimed in claim 12 further comprising:

a thruster control circuit coupled to the power distribution circuit for providing input signals to the power distribution circuit;

a discharge power supply coupled to the cathode assembly and the thruster control circuit for providing anode current;

a thruster coupled to the discharge power supply and the power distribution circuit for producing thrust.

17. The control apparatus as claimed in claim 8 further comprising:

a diode for providing current to the cathode assembly when conducting.

18. The control apparatus as claimed in claim 8 further comprising:

one or more auxiliary power supplies coupled to the power distribution circuit for providing additional electrical power to the power distribution circuit.

19. A method for controlling discharge components comprising:

providing an electron beam generating device;

providing a magnetic field generating device;

providing a power source; and distributing power from said power source to the electron beam generating device and/or the magnetic field generating device by operation of a plurality of switching devices.

20. The method as claimed in claim 19 further comprising:

coupling an anode to the electron beam generating device.

21. The method as claimed in claim 19 further comprising:

providing at least one auxiliary power source.

* * * * *